United States Patent [19]

West

[11] Patent Number: 5,054,081

[45] Date of Patent: Oct. 1, 1991

[54] ELECTROSTATIC TRANSDUCER WITH IMPROVED BASS RESPONSE UTILIZING DISTURBED BASS RESONANCE ENERGY

[76] Inventor: Roger A. West, 6451 Mountain View Dr., Park City, Utah 84060

[21] Appl. No.: 324,994

[22] Filed: Mar. 15, 1989

Related U.S. Application Data

[63] Continuation of Ser. No. 105,505, Oct. 1, 1987, abandoned, which is a continuation of Ser. No. 719,135, Apr. 2, 1985, abandoned.

[51] Int. Cl.[5] ..... H04R 25/00

[52] U.S. Cl. ..... 381/191; 381/203

[58] Field of Search ..... 381/113, 116, 174, 169, 381/188, 182, 191, 190, 203, 98

[56] References Cited

U.S. PATENT DOCUMENTS

| | | | |
|---|---|---|---|
| 1,983,377 | 12/1934 | Kellogg | 179/111 R |
| 2,975,243 | 3/1961 | Katella | 179/111 R |
| 3,008,013 | 11/1961 | Williamson et al. | 179/111 R |
| 3,821,492 | 6/1974 | Tamura et al. | 179/181 R |
| 3,892,927 | 7/1975 | Lindenberg | 179/111 R |

*Primary Examiner*—Forester W. Isen

*Attorney, Agent, or Firm*—Warren B. Kice

[57] ABSTRACT

An electrostatic transducer in which a plurality of stretched diaphragm sections are electrostatically charged and an electrical field exerts an electromagnetic force on the diaphragm sections. The electric field varies in response to variations in an input signal to cause responsive movement of the diaphragm sections. Each of said diaphragm sections is constructed and arranged to have a resonant frequency that differs from that of the other diaphragm sections.

8 Claims, 2 Drawing Sheets

ELECTROSTATIC TRANSDUCER WITH IMPROVED BASS RESPONSE UTILIZING DISTURBED BASS RESONANCE ENERGY

This is a continuation of co-pending application Ser. No. 105,505 filed on Oct. 1, 1987, now abandoned which is a continuation of Ser. No. 719,135 on Apr. 2, 1985 now abandoned.

BACKGROUND OF THE INVENTION

The present invention relates to transducers, and particularly to electrostatic loudspeakers for the reproduction of music.

A conventional electrostatic loudspeaker is normally composed of a thin membrane, or diaphragm, made of Mylar, or the like that is stretched between two acoustically open wire grids, or plates. The latter plates are connected to a coupling transformer which provides a high voltage audio signal, and the diaphragm is connected to a high voltage, low current bias supply which provides an electrostatic charge that becomes trapped in the diaphragm.

The two acoustically open plates provide an electric field that is the voltage equivalent of the audio signal and which exerts forces on the electrostatic charge that is trapped in the diaphragm. These forces are transferred to the diaphragm causing the diaphragm to move in synchronization with the forces and reproduce the input signal.

The electrostatic loudspeaker enjoys several advantages when compared to normal dynamic speakers consisting of a frame housing a magnet and a voice coil attached to the apex of a cone which is suspended at the edge by a flexible cloth or the like. For example, the moving member, i.e., the moving diaphragm of the electrostatic loudspeaker is very thin and light (i.e. its thickness is usually only $0.0002 \pm 0.000025$ inches and it weighs only as much as a body of air 7 millimeters thick whose boundaries are equal to those of the moving diaphragm). Also, the electric field which acts to make the diaphragm move exerts its actuating force uniformly over essentially the entire area of the diaphragm. A diaphragm of such extreme lightness in combination with the uniformly distributed actuating force results in a diaphragm motion that is a very good replica of the electrical forces acting upon it. In addition, all sections of the diaphragm surface move with highly accurate phase and amplitude linearity throughout its entire range of travel at all frequencies within its area of operation.

Another advantage of the electrostatic transducer is that it is inherently a unit with low mechanical impedance at all frequencies. Thus, it couples to the air with reasonable efficiency at all frequencies which is not necessarily the case for dynamic units which are encumbered by a relatively high mechanical impedance. As a result, the electrostatic transducer performs well down to its frequency limits and within its maximum excursibility with virtually equal fidelity at all drive levels.

However, two potential problems do result in the design and use of an electrostatic transducer. First of all, at the resonant frequency a response peak is exhibited by the stretched, under-damped diaphragm which is very responsive and dynamic. Therefore, the diaphragm tends to "slap" the plates with very little provocation, since every unit of diaphragm area contributes its parcel of energy to the energy peak.

Attempts have been made to eliminate the resonant peak mentioned above. However, these attempts usually dissipate the energy of the peak without putting it to work and, in addition, restricts the dynamic range not at just the peak frequency but over an adjacent range of frequencies.

Also, the vibrating diaphragm of an electrostatic transducer is normally permitted to propagate freely in its environment and, as such, has acoustic energy emanating from both of its sides to minimize colorations in the reproduced signal. However, since the two waves radiating from the two sides of the diaphragm are mutually out of phase they begin to cancel one another at lower frequencies where acoustic wavelengths are longer than the physical dimensions of the speaker. This results in poor bass response at the lower frequencies.

SUMMARY OF THE INVENTION

It is therefore an object of the present invention to provide a electrostatic transducer which exhibits all of the aforementioned advantages of the electrostatic transducer while eliminating the problems normally associated therewith.

It is a further object of the present invention to provide an electrostatic transducer of the above type in which the resonant response peak caused by the stretched, underdamped diaphragm is virtually eliminated.

It is a still further object of the present invention to provide an electrostatic transducer of the above type in which the efficiency of the lower frequency reproduction increases due to the fact that the transducer functions on sensitive resonant energy.

It is a still further object of the present invention to provide an electrostatic transducer of the above type in which the bass response is devoid of single peak bass and is dynamic and unrestrained.

It is a still further object of the present invention to provide an electrostatic transducer of the above type in which different sections of the diaphragm resonate at different frequencies in a graded fashion, to distribute the resonant energy over the pass band of the bass portion of the transducer.

It is a still further object of the present invention to provide an electrostatic transducer of the above type in which the destructive effects of dipole cancellation are minimized.

Toward the fulfillment of these and other objects, the electrostatic transducer of the present invention comprises a plurality of stretched diaphragm sections which are electrostatically charged. An electrical field is provided which exerts an electromagnetic force on the diaphragm sections, and the electric field is varied in response to variations in an audio signal to cause responsive movement of the diaphragm sections. Each of the diaphragm sections is constructed and arranged to have a resonant frequency that differs from that of the other diaphragm sections.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENTS

Figure 1:
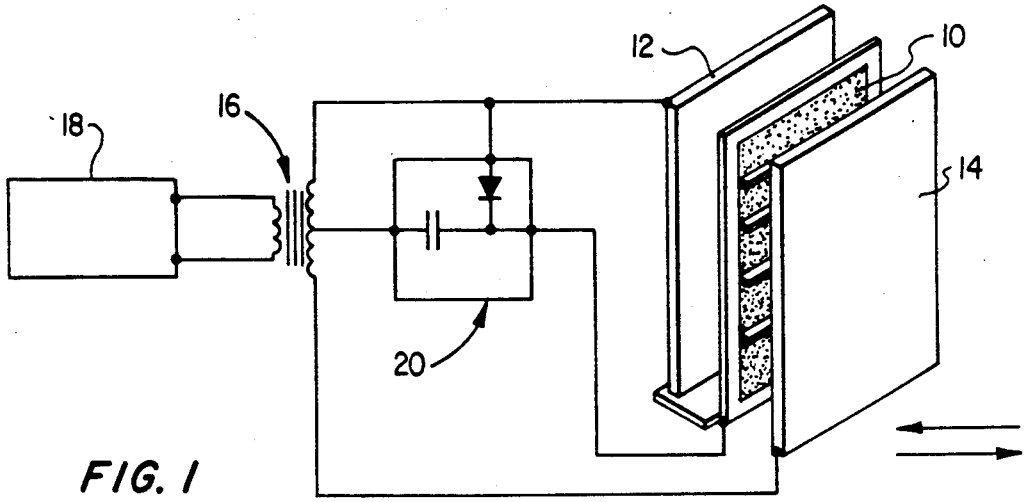
FIG. 1 is a schematic diagram illustrating the principles of operation of the electrostatic transducer of the present invention.

Referring to FIG. 1 of the drawings, the reference numeral 10 refers in general to a thin plastic (such as Mylar) membrane, or diaphragm 10, stretched and contained between two acoustically open wire grids, or plates, 12 and 14. The two plates 12 and 14 are connected to either end of a coupling transformer 16 whose input is connected to an audio power amplifier 18 which provides an amplified, high voltage, audio signal.

The diaphragm 10 is connected to a high voltage, low current bias supply circuit, shown in general by the reference numeral 20, which provides an electrostatic charge to the diaphragm. The two plates 12 and 14 provide an electric field that is the voltage equivalent of the audio signal. In the presence of an audio signal, the electric field exerts electrostatic forces on the electrostatic charge on the diaphragm 10. These forces are transferred to the diaphragm, causing it to vibrate in synchronization with the forces and therefore with the audio signal.

Since the components described thus far, as well as their respective functions, are known in the art they will not be described in any further detail.

Figure 2:
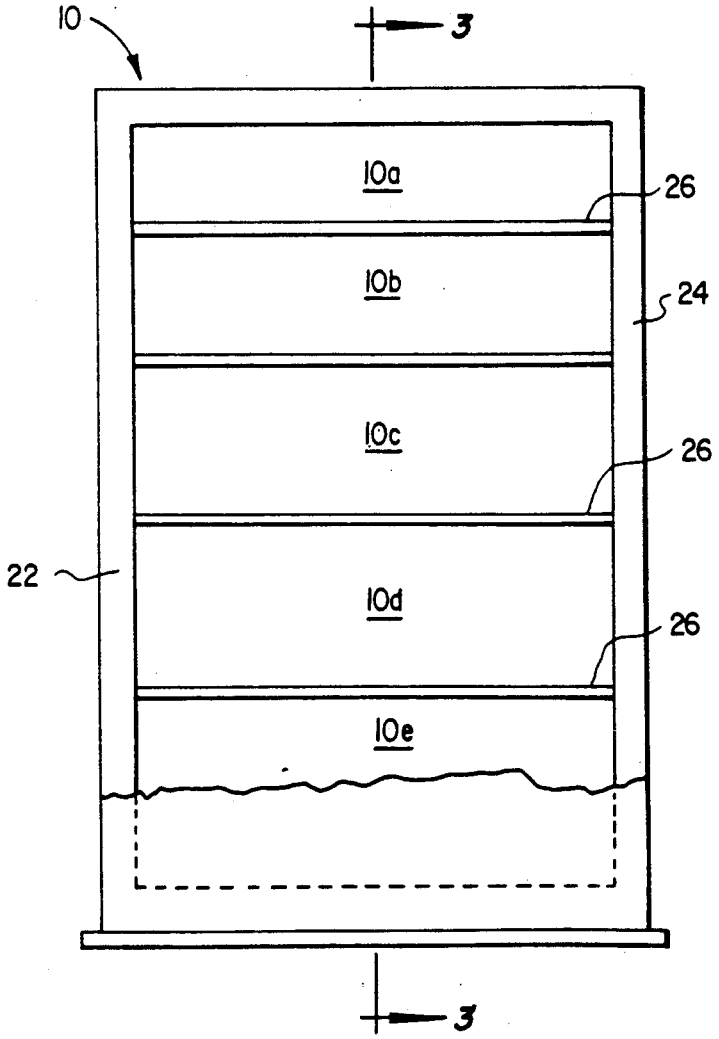
FIG. 2 is a front elevational view of one embodiment of the diaphragm sections of the electrostatic transducer of the present invention.
Figure 3:
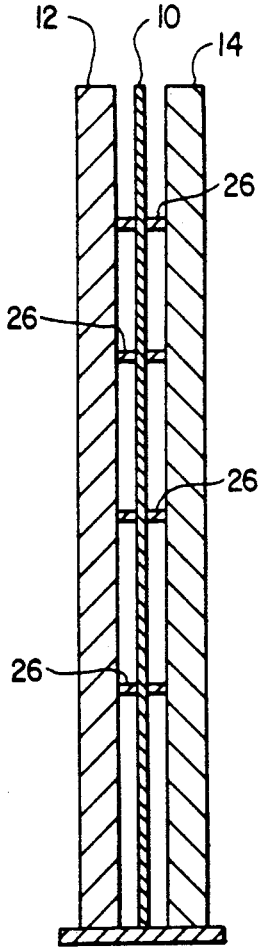
FIG. 3 is a side elevational view of the embodiment of the electrostatic transducer of the present invention shown in FIG. 2.

According to the present invention the diaphragm 10 is divided into a plurality of sections, each having a resonant frequency that differs from that of the other sections. One of the techniques for achieving this is depicted in FIGS. 2 and 3. In this embodiment, five diaphragm sections 10*a*, 10*b*, 10*c*, 10*d*, and 10*e* extend between the side members 22 and 24 of a frame circumscribing the diaphragm sections. The widths of the section 10*a*–10*e*, as viewed in FIG. 2, are equal and the outer transverse margins of each section are secured to the frame members 22 and 24 in any known manner.

The heights of the sections 10*a*–10*e* increase in a graded fashion in a direction from top to bottom as viewed in FIG. 2, i.e. the height of the uppermost section 10*a* is less than that of its adjacent section 10*b*, the height of section 10*b* is less than that of 10*c*, and so on. As a result, the diaphragm sections 10*a*–10*e* have different areas and therefore different resonant frequencies. The respective areas and corresponding resonant frequencies of the diaphragm sections 10*a*–10*e* are selected so that their respective maximum acoustic amplitudes, as well as the variations in amplitude with frequency up to and down from their maximum amplitudes are substantially identical, as will be described in detail later.

One technique of forming the individual diaphragm sections is to divide one large diaphragm section into the five separate sections 10*a*–10*e*. This can be done by disposing a plurality of dividers 26 between the diaphragm 10 and the plates 12 and 14 as shown in FIG. 3. Each divider 26 can be constructed of foam rubber or the like and can simply be wedged between the diaphragm 10 and the plates 12 and 14 or, alternately, can be fastened between the frame members 22 and 24 to form the five different diaphragm sections.

Alternately, five separate diaphragm sections, which would be identical in size and shape to the sections 10*a*–10*e*, can be placed between the frame members 22 and 24.

Other techniques for forming diaphragm sections of varying areas can be used within the scope of the invention. For example, the cross section of the diaphragm 10 can vary in width in a longitudinal (vertical) direction to form a tapered cross section, with the width of each section varying from that of the other sections. In this arrangement, the height of each section can be the same, or can vary, as long as each section has a different area and therefore a different resonant frequency with the foregoing.

Also, instead of dividing the diaphragm into a plurality of horizontal sections, the diaphragm can be divided up vertically to form a plurality of vertical sections of varying widths and/or heights. As still another alternative, the diaphragm 10 can be divided up horizontally and vertically in a manner to produce a plurality of individual sections varying in area, and therefore resonant frequency.

Figure 4:
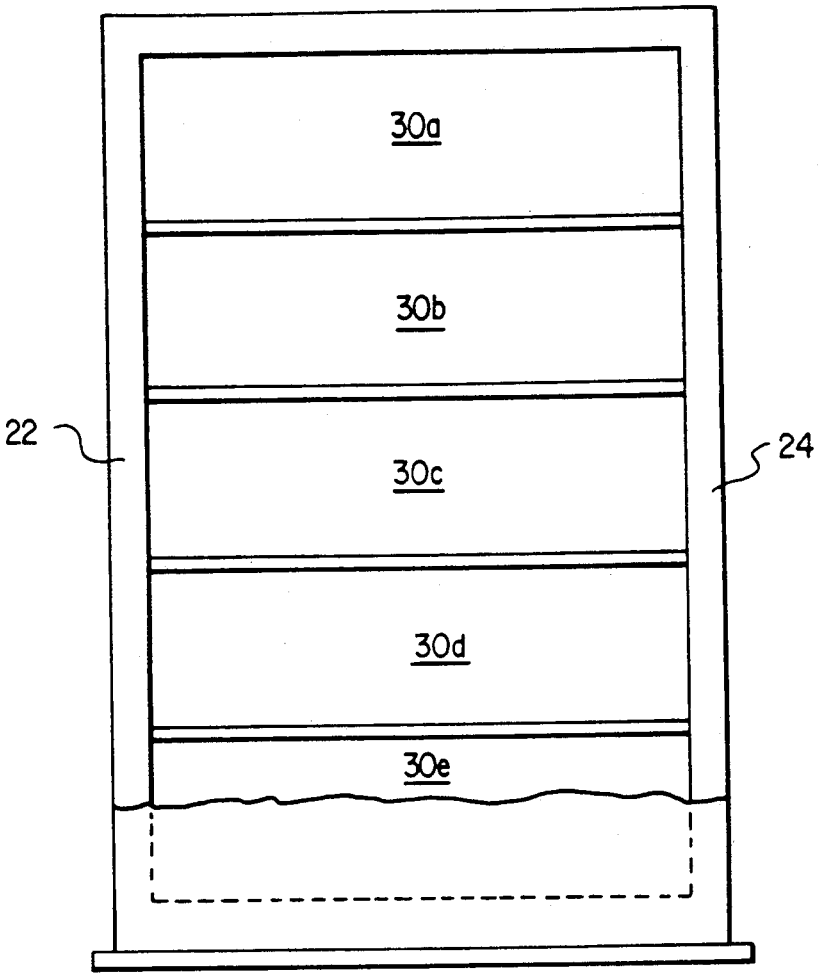
FIG. 4 is a view similar to FIG. 2 but depicting an alternate embodiment of the electrostatic transducer of the present invention.

Another embodiment of the present invention is depicted in FIG. 4, which is similar to FIG. 2 with the exception that five separate diaphragm sections 30*a*–30*e* are provided which are identical in size. The resonant frequencies of the diaphragm sections 30*a*–30*e* are varied by varying the respective tensions of the sections. This can be done simply by stretching the sections 30*a*–30*e* between the frame members 22 and 24 at varying tensions with the same considerations of acoustic amplitude and roll-off characteristics as discussed above.

Alternatively, the equal-sized sections 30*a*–30*e* can be at the same tension but their respective masses varied in order to vary their respective resonant frequencies in accordance with the above. The respective masses can be varied in several manners such as by utilizing sections of different materials or by using sections of the same materials but having different thicknesses.

As indicated earlier, the resonant frequencies of the diaphragm sections 10*a*–10*e* are selected by any of the techniques described above so that their respective maximum acoustic amplitudes, as well as the variations in amplitude with frequency up and down from their maximum amplitudes ar substantially identical. The frequencies are selected so that the response curve (variation in acoustic amplitude with frequency) of each section intersects the response curve of an adjacent section at a predetermined amplitude below resonance. As a result, flat acoustic response is obtained by summing the distributed resonant energy.

Figure 5:
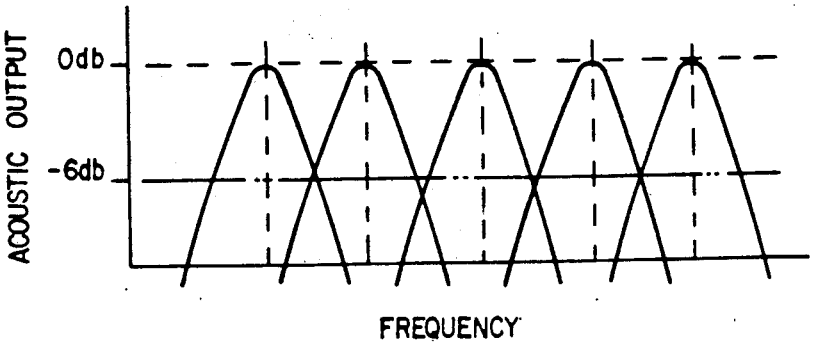
FIG. 5 is a graph depicting the variations in acoustic output with frequency of each of the individual diaphragm sections of the electrostatic transducer of the present invention.

In the example shown by the graph of FIG. 5, the resonant frequencies are adjusted so that the intersection level of adjacent resonant frequencies are all at −6 db, resulting in a substantially flat acoustic response obtained by summing the distributed energy of all of the peaks of the respective curves. Of course, the respective intersection levels can be varied to produce a rising response curve, a falling response curve, or a response curve that rises and falls in any predetermined manner depending on the particular application of the loudspeaker and the acoustic environment in which it is placed.

An electrostatic loudspeaker constructed in any of the foregoing manners exhibits all of the above-mentioned advantages of a conventional electrostatic loudspeaker without a single, relatively large, amplitude peak at resonant frequency. Also the dipole cancellation discussed above is eliminated by packing adjacent resonant peaks together to give a complimentary peak to offset the cancellation and the loudspeaker can be custom designed for a particular acoustic environment, with its unique reflective characteristics, etc., by adjusting the respective resonant frequencies of the different diaphragm sections accordingly.

It is understood that several other variations may be made in the foregoing without departing from the scope of the invention. For example, while a loudspeaker was described by means of example, it is understood other types of transducer such as an electrostatic microphone would fall within the scope of the present invention.

Other variations in the foregoing can be made without departing from the scope of the invention which is defined in the appended claims.

What is claimed is:

1. A transducer comprising a plurality of stretched diaphragm sections, and means electrically connected to an audio signal source for vibrating said diaphragm sections in response to variations in said signal to cause acoustic energy to emanate from opposite surfaces of each of said sections to reproduce said audio signal, the acoustic energy emanating from one side of each diaphragm section tending to cancel the acoustic energy emanating from the other side thereof through a range of relatively low frequencies, said diaphragm sections having different physical characteristics so as to create resonant peaks at different frequencies a plurality of said peaks being located within said range of frequencies to offset the effects of said cancellation.

2. The transducer of claim 1 wherein said diaphragm sections are of different sizes.

3. The transducer of claim 1 wherein said diaphragm sections have different masses.

4. The transducer of claim 1 wherein said diaphragm sections are at different tensions.

5. A transducer comprising a plurality of stretched diaphragm sections adapted to vibrate in response to the presence of acoustic energy against opposite surface of each of said sections, and means cooperating with said diaphragm section for generating an output signal in response to said vibrations, the acoustic energy emanating from one side of each diaphragm section tending to cancel the acoustic energy emanating from the other side thereof through a range of relatively low frequencies, said diaphragm sections having different physical characteristics so as to create resonant peaks at different frequencies a plurality of peaks being located within said range of frequencies to offset the effects of said cancellation.

6. The transducer of claim 5 wherein said diaphragm sections are of different sizes.

7. The transducer of claim 5 wherein said diaphragm sections have different masses.

8. The transducer of claim 5 wherein said diaphragm sections are of different tensions.

* * * * *

UNITED STATES PATENT AND TRADEMARK OFFICE

CERTIFICATE OF CORRECTION

PATENT NO. : 5,054,081

DATED : October 1, 1991

INVENTOR(S) : Roger West

It is certified that error appears in the above-identified patent and that said Letters Patent is hereby corrected as shown below:

On the title page, item [54], line 3 and in col. 1, line 3, in the title change "DISTURBED" to --DISTRIBUTED--.

Column 6, line 4, after "frequencies" insert --,--.

Column 6, line 24, after "frequencies" insert --,--.

Signed and Sealed this

Sixth Day of October, 1992

*Attest:*

DOUGLAS B. COMER

*Attesting Officer*

*Acting Commissioner of Patents and Trademarks*

US005054081A

REEXAMINATION CERTIFICATE (2326th)

United States Patent [19]

West

[11] B1 5,054,081

[45] Certificate Issued Jun. 28, 1994

[54] ELECTROSTATIC TRANSDUCER WITH IMPROVED BASS RESPONSE UTILIZING DISTRIBUTED BASS RESONANCE ENERGY

[76] Inventor: Roger A. West, 6451 Mountain View Dr., Park City, Utah 84060

Reexamination Request:
No. 90/002,975, Feb. 26, 1993

Reexamination Certificate for:

| | |
|---|---|
| Patent No.: | 5,054,081 |
| Issued: | Mar. 15, 1989 |
| Appl. No.: | 324,994 |
| Filed: | Oct. 1, 1991 |

Certificate of Correction issued Oct. 6, 1992.

Related U.S. Application Data

[63] Continuation of Ser. No. 105,505, Oct. 1, 1987, abandoned, which is a continuation of Ser. No. 719,135, Apr. 2, 1985, abandoned.

[51] Int. Cl.[5] ..... H04R 25/00

[52] U.S. Cl. ..... 381/191; 381/203

[58] Field of Search ..... 381/190, 191, 203

[56] References Cited

U.S. PATENT DOCUMENTS

| | | |
|---|---|---|
| 1,983,377 | 12/1934 | Kellogg . |
| 2,975,243 | 3/1961 | Katella . |
| 3,008,013 | 11/1961 | Williamson et al. . |
| 3,674,946 | 7/1972 | Winey . |
| 3,892,927 | 7/1975 | Lindenberg . |
| 3,919,499 | 11/1975 | Winey . |
| 3,921,492 | 6/1974 | Tamura et al. . |

*Primary Examiner*—Forester W. Isen

[57] ABSTRACT

An electrostatic transducer in which a plurality of stretched diaphragm sections are electrostatically charged and an electrical field exerts an electromagnetic force on the diaphragm sections. The electric field varies in response to variations in an input signal to cause responsive movement of the diaphragm sections. Each of said diaphragm sections is constructed and arranged to have a resonant frequency that differs from that of the other diaphragm sections.

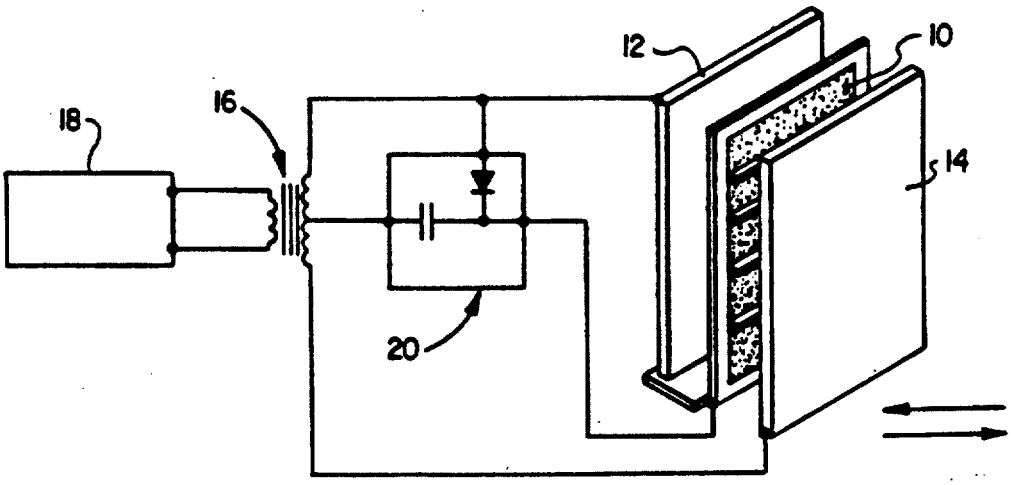

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

Claims 1–8 are cancelled.

* * * * *